US006619980B1

(12) United States Patent
Hsiao

(10) Patent No.: US 6,619,980 B1
(45) Date of Patent: Sep. 16, 2003

(54) DEFORMABLE ENCLOSURE FOR A MULTI-HOLE SOCKET TO PARTIALLY CONCEAL ELECTRICAL WIRES CONNECTED TO THE SOCKET SO AS TO ENHANCE OVERALL APPEARANCE OF THE SOCKET

(75) Inventor: Feng-Shen Hsiao, Taipei (TW)

(73) Assignee: Rite-Tech Industrial Co., Ltd., Taipei (TW)

( * ) Notice: Subject to any disclaimer, the term of this patent is extended or adjusted under 35 U.S.C. 154(b) by 0 days.

(21) Appl. No.: 10/107,460

(22) Filed: Mar. 28, 2002

(51) Int. Cl.[7] ..... H01R 13/73
(52) U.S. Cl. ..... 439/501; 439/502
(58) Field of Search ..... 439/501, 502, 439/147; 174/66, 67

(56) References Cited

U.S. PATENT DOCUMENTS 2,561,740 A * 7/1951 Kennedy ..... 173/361
3,013,105 A * 12/1961 Craig ..... 174/67
5,195,901 A * 3/1993 Correnti ..... 439/147

* cited by examiner

*Primary Examiner*—Alexander Gilman
(74) *Attorney, Agent, or Firm*—Bacon & Thomas, PLLC

(57) ABSTRACT

An enclosure for a socket having plugs electrically connected to the socket and each plug having a wire extending out from the plug, includes a neck adapted to be integrally extending out from a bottom of the socket, and a skirt detachably connected to a distal end of the neck. The skirt is deformable so as to define a receiving space and a hole communicating with the receiving space. The neck is provided for having the wires wound therearound so as to enhance the connection between the plugs and the socket. The deformation of the skirt conceals a portion of the wires inside the receiving space and then the wires extend out from the hole.

10 Claims, 5 Drawing Sheets

DEFORMABLE ENCLOSURE FOR A MULTI-HOLE SOCKET TO PARTIALLY CONCEAL ELECTRICAL WIRES CONNECTED TO THE SOCKET SO AS TO ENHANCE OVERALL APPEARANCE OF THE SOCKET

BACKGROUND OF THE INVENTION

1. Field of the Invention

The present invention relates to an enclosure for a multi-hole socket, and more particularly to an enclosure which is deformable to conceal a portion of each electrical wire electrically connected to the socket, such that the overall appearance of the socket is enhanced.

2. Description of Related Art

A conventional multi-hole socket (5) is shown in FIG. 5. The socket (5) has multiple pairs of holes (51,52) (only two pairs of holes are shown in this drawing) each defined in a side face of the socket (5) and a pair of light emitting diodes (LED) (53). The socket (5) has a pair of contact pins (54) extending in parallel from a side face of the socket (5) so that the socket (5) is able to electrically connect to an outlet in the wall by means of the contact pins (54).

When this kind of socket (5) is in use and all the pairs of holes (51,52) are so packed with plugs (not shown), the electrical wires extending out from each of the plugs will tangle with each other and thus cause an unsightly mess. Users of modem hi-tech equipment such as computers are very conscious of design and style in their workplace, so this mess of wiring is quite displeasing.

To overcome the shortcomings, the present invention tends to provide an improved socket to mitigate and obviate the aforementioned problems.

SUMMARY OF THE INVENTION

The primary objective of the present invention is to provide an improved enclosure securely attached to a peripheral edge of the socket. The enclosure is deformable so that the enclosure defines a receiving space and a hole after the deformation of the enclosure. With the receiving space, a portion of the electrical wires is able to be concealed inside the receiving space. With the hole, the rest of the electrical wires extend out of the socket such that the overall appearance of the socket is enhanced.

Other objects, advantages and novel features of the invention will become more apparent from the following detailed description when taken in conjunction with the accompanying drawings.

DETAILED DESCRIPTION OF THE PREFERRED EMBODIMENT

Figure 1:
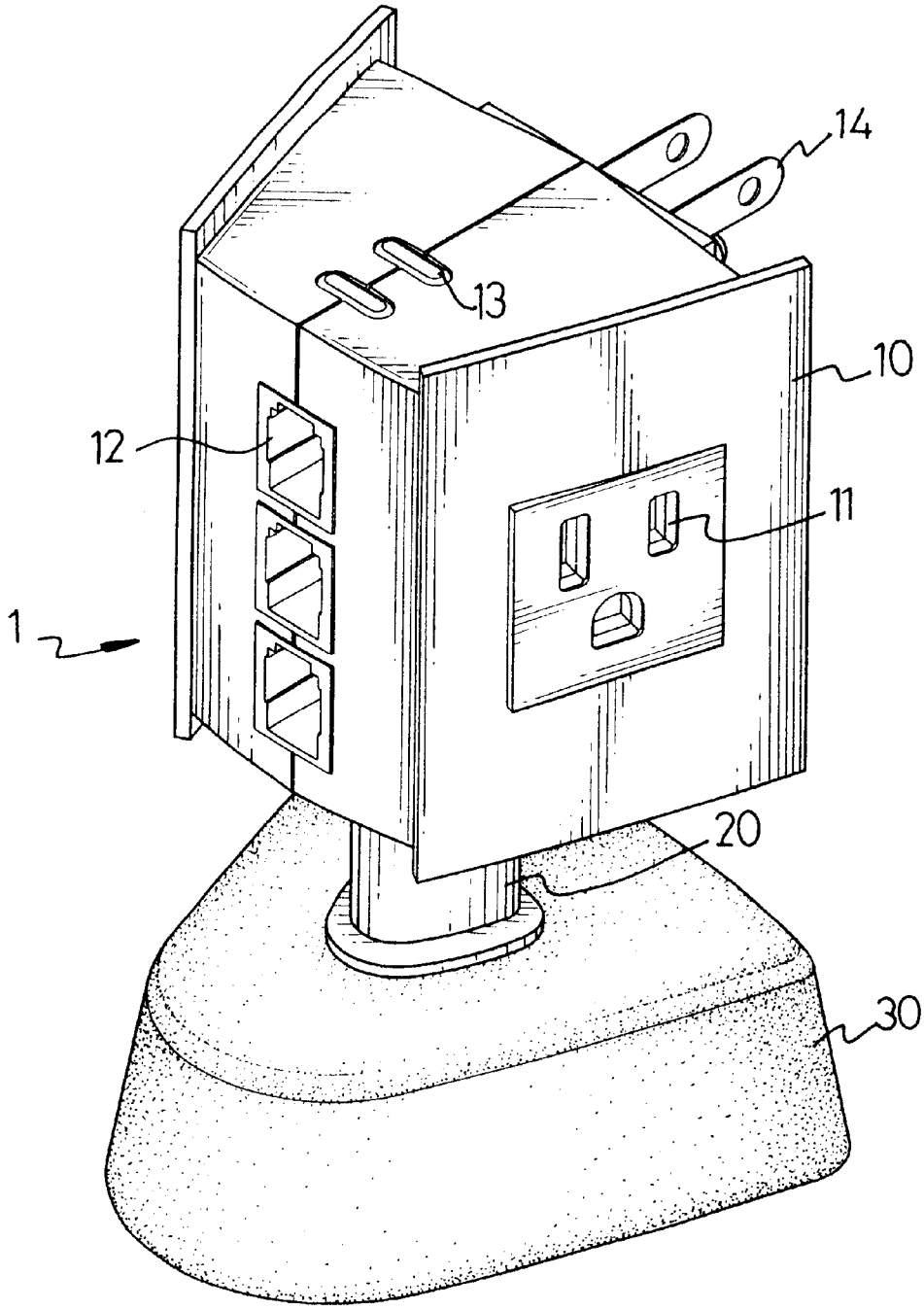
FIG. 1 is a perspective view of the socket with the enclosure of the present invention.

With reference to FIG. 1, a socket (1) constructed in accordance with the present invention has a body (10), a neck (20) and a skirt (30).

The body (10) has multiple pairs of holes (11,12) (only two pairs of holes are shown in this preferred embodiment), each pair of holes (11,12,13) being defined in a respective side face of the body (10) and may be different in configuration with one another such that the body (10) is able to connect to different plugs (not shown). A pair of LEDs (13) are also provided with the body (10). The body (10) further has a pair of contact pins (14) extending out from a side face to connect to a power source.

The neck (20) integrally extends from a side face of the body (10). The skirt (30) is made of a resilient material and is securely connected to a distal end of the neck (20). The skirt (30) is approximately triangular in shape.

Figure 2:
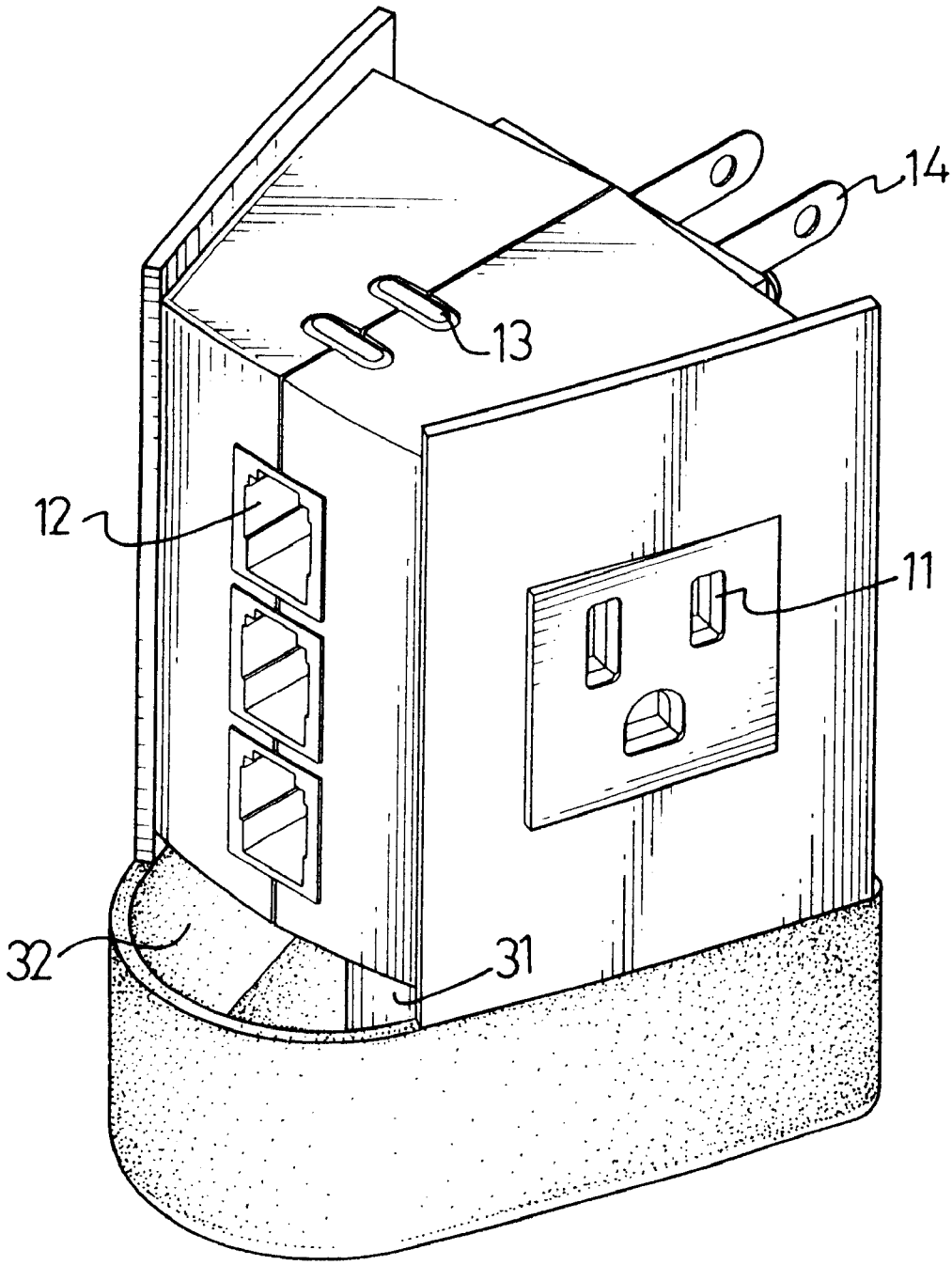
FIG. 2 is a perspective view showing that the enclosure is deformed to define a receiving space under the socket.

With reference to FIG. 2, it is noted that the skirt (30) is deformable so that when the skirt (30) is flipped over, a distal periphery of the skirt (30) engages with a distal periphery of the body (10), which defines a receiving space (31) between the skirt (30) and the body (10) and a hole (32) defined to communicate the receiving space (31) with the air.

Figure 3:
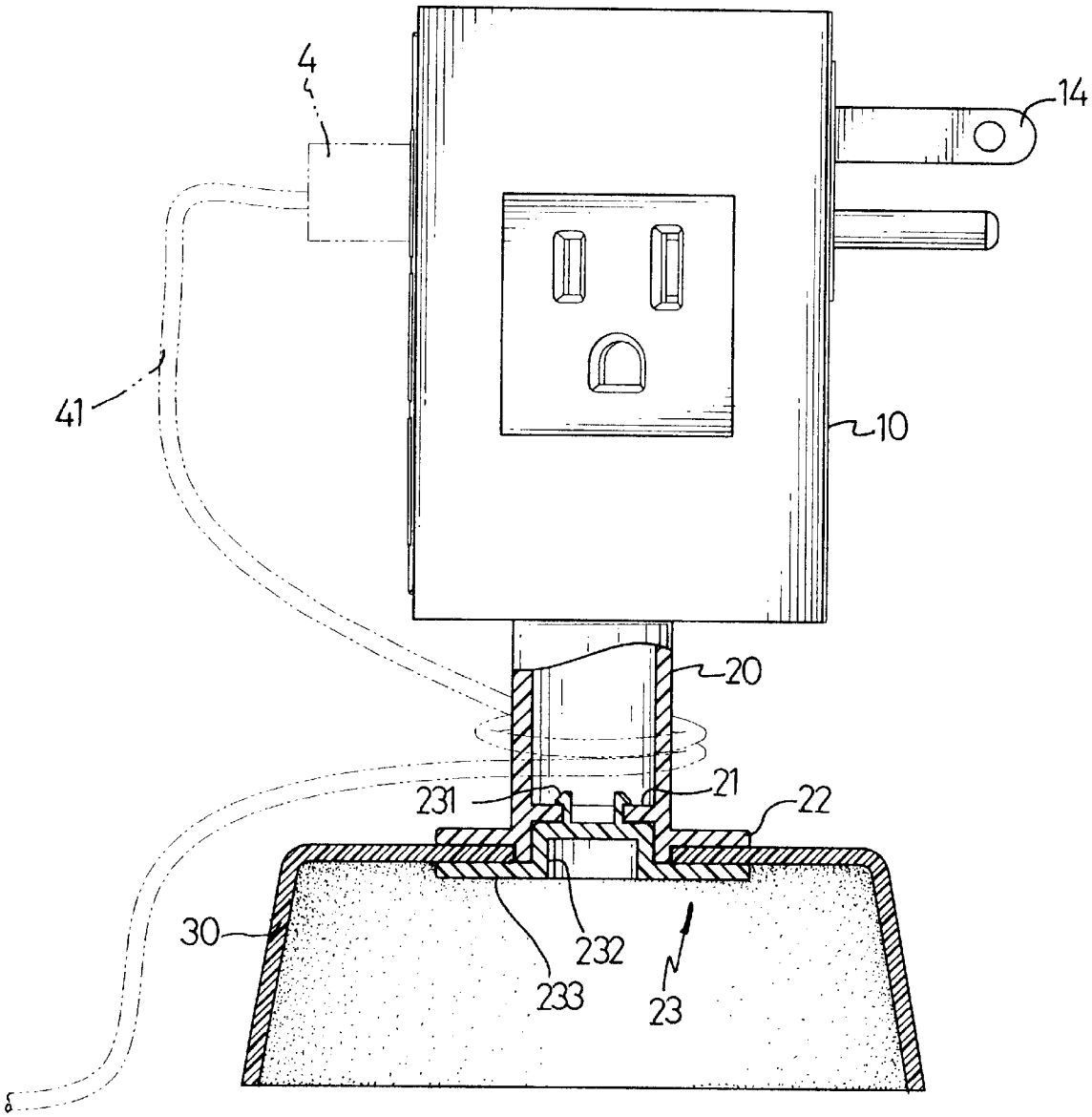
FIG. 3 is a schematic side view showing that a portion of the electrical wire is wound around a neck formed between the socket and the enclosure.
Figure 4:
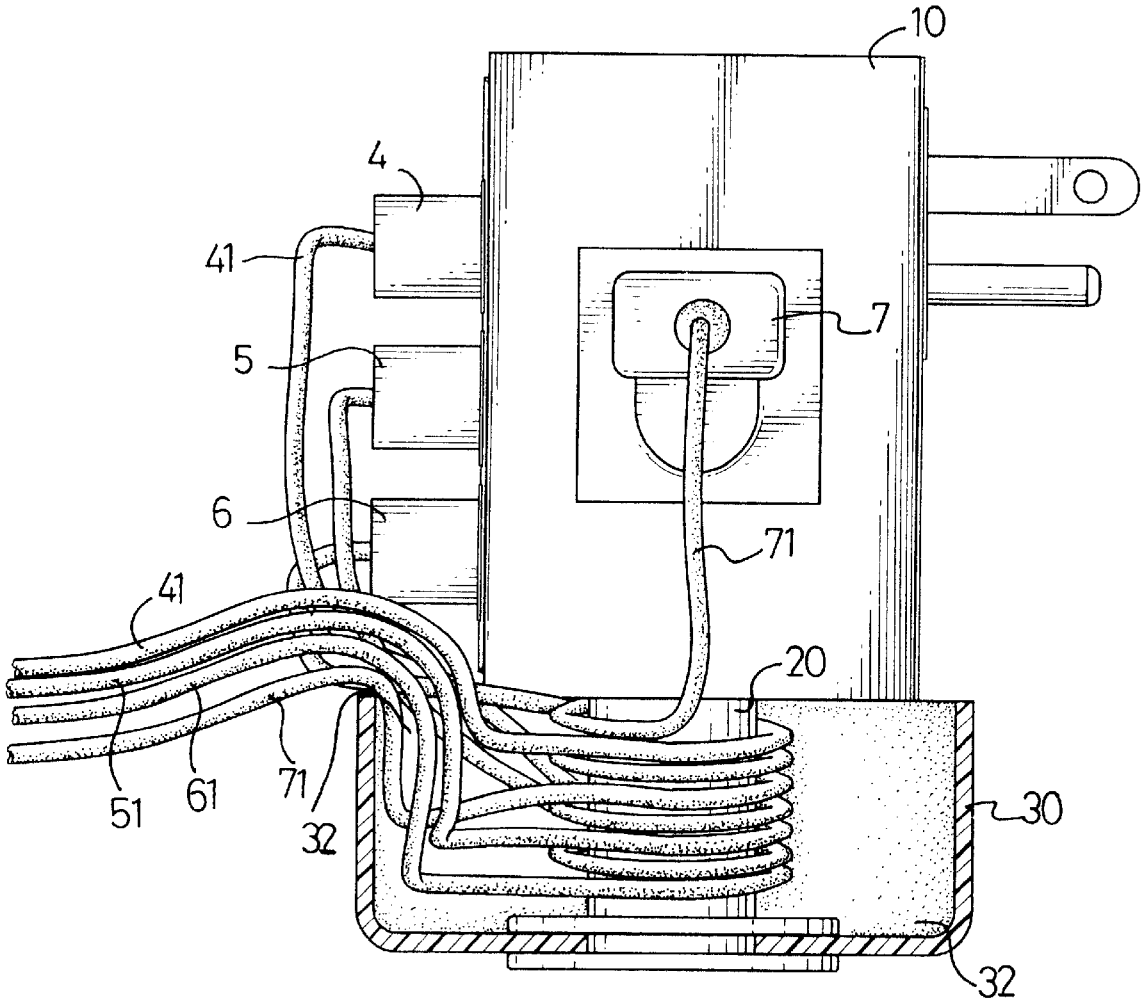
FIG. 4 is a schematic view showing that the exposed appearance of the socket is tidy even after multiple plugs are plugged to the multiple pairs of holes.
Figure 5:
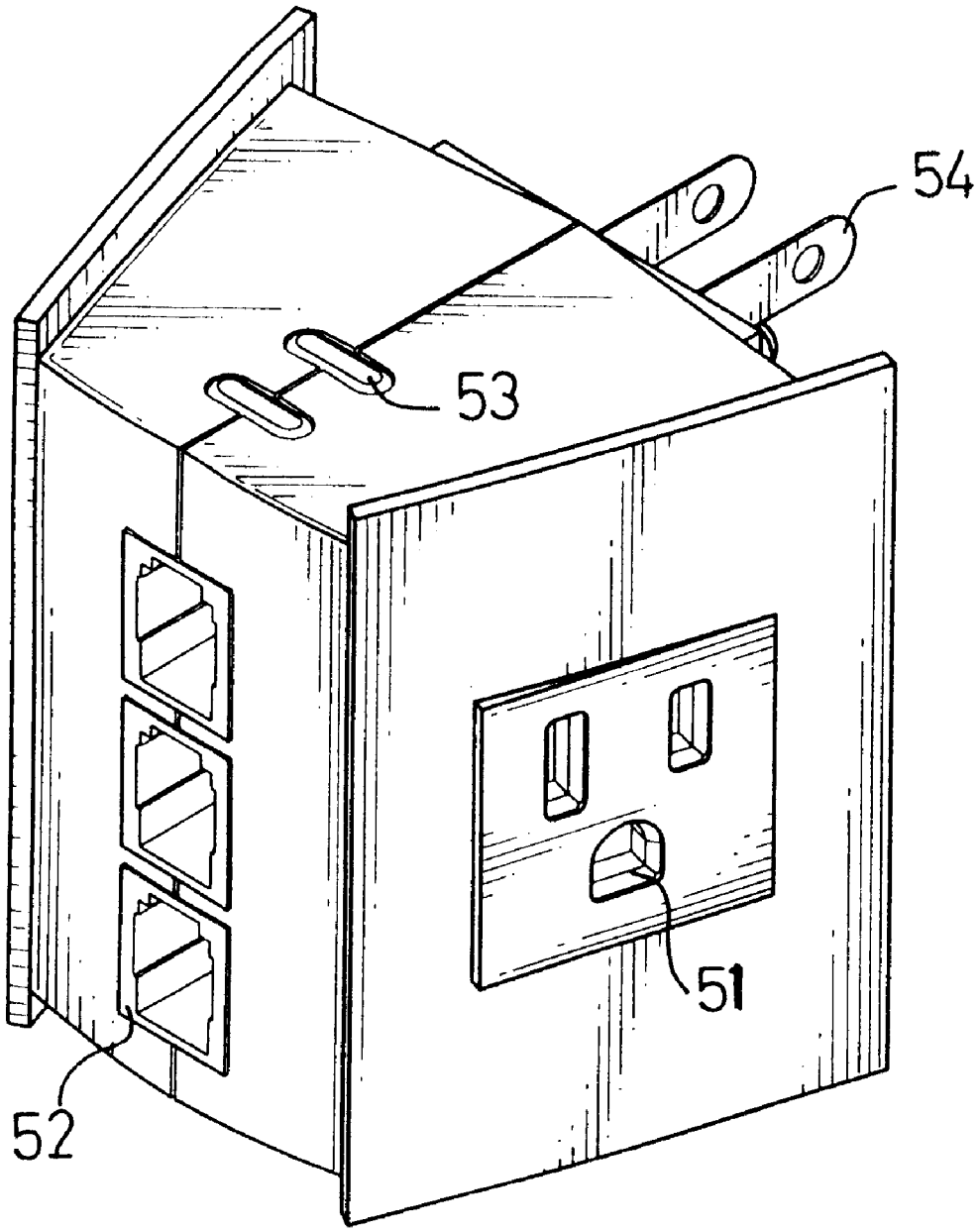
FIG. 5 PRIOR ART
FIG. 5 is a perspective view of a conventional socket.

With reference to FIG. 3, it is noted that when the socket of the present invention is in use, the user first uses a plug (4) with a wire (41) to plug into one pair of holes, e.g., the pair of holes (12). Then the user winds the wire (41) around the neck (20). Thereafter, as shown in FIG. 4, the user flips over the skirt (30) to enclose the wire (41) inside the receiving space (31) and thus allows the wire (41) to extend out of the receiving space (31) from the hole (32).

After the pairs of holes (11,12) are all connected with plugs (4,5,6,7), the wires (41,51,61,71) are wound around the neck (20) first and then extend out of the socket (1) from the hole (32). Because all the wires (41,51,61,71) extend from the same hole (32), the overall appearance of the socket (1) of the invention is tidy. Furthermore, before all the wires (41,51,61,71) extend out of the socket (1) from the hole (32), the wires (41,51,61,71) are wound around the neck (20) first, such that if the wires (41,51,61,71) are accidentally stretched, the connection between the plugs (4,5,6,7) and the body (10) is still secured.

From FIG. 3, it is noted that the skirt (30) may be detachably connected to the neck (20). That is, the neck (20) is hollow and has an inner flange (21) formed on an inner face thereof and an outer flange (22) formed on an outer face thereof. A clamp (23) has a pair of resilient hooks (231) oppositely formed on a top face thereof and a bottom plate (233) integrally connected to the top face of the clamp (23) by means of a wall (232). It is noted from the drawing that a thickness between the top face and the bottom face of the clamp (23) is at least the same as that of the combination of the thickness of the outer flange (22) and the thickness of the skirt (30). A height of each of the hooks (231) is at least the same as a thickness of the inner flange (21). Thus, after the peripheral edge of the skirt (30) is placed under the outer flange (22), the engagement of the hooks (231) with the inner flange (21) allows the clamp (23) to securely clamp the skirt (30).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A deformable enclosure for a socket having plugs electrically connected to the socket and each plug having a wire extending out from the plug, the enclosure comprising:

a neck adapted to be integrally extending out from a bottom of the socket; and a skirt detachably connected to a distal end of the neck, the skirt being deformable so as to so as to define a receiving space and a hole communicating with the receiving space, a clamp to detachably clamp the skirt to the neck, wherein the clamp has a pair of oppositely formed hooks on a top face of the clamp and a bottom plate integrally connected to the top face of the clamp by means of a wall, whereby the neck is provided for having the wires wound therearound so as to enhance the connection between the plugs and the socket, and the deformation of the skirt conceals a portion of the wires inside the receiving space and the wires extend out from the hole.

2. The enclosure as claimed in claim 1, wherein the neck has an outer flange formed on an outer face thereof to correspond to the bottom plate and an inner flange formed on an inner face thereof to correspond to the pair of hooks.

3. The enclosure as claimed in claim 2, wherein a thickness between the top face and a bottom face of the clamp is at least the same as that of a combination of a thickness of the outer flange and a thickness of the skirt.

4. The enclosure as claimed in claim 2, wherein a height of each of the hooks is at least the same as a thickness of the inner flange, thereby after the peripheral edge of the skirt is place under the outer flange, the engagement of the hooks with the inner flange allows the clamp to securely clamp the skirt.

5. The enclosure as claimed in claim 3, wherein a height of each of the hooks is at least the same as a thickness of the inner flange, thereby after the peripheral edge of the skirt is placed under the outer flange, the engagement of the hooks with the inner flange allows the clamp to securely clamp the skirt.

6. An enclosure in combination with a socket;

the socket comprising:

a body having multiple pairs of holes defined in a respective side face thereof, a pair of contact pins extending out from a side face thereof for connection with a power source;

the enclosure comprising:

a neck integrally extending out from a bottom of the socket;

a skirt detachably connected to a distal end of the neck, the skirt being deformable so as to define a receiving space and a hole communicating with the receiving space, a clamp to detachably clamp the skirt to the neck, wherein the clamp has a pair of oppositely formed resilient hooks on a top face of the clamp and a bottom plate integrally connected to the top face of the clamp by means of a wall, whereby the neck is provided for having the wires wound therearound so as to enhance the connection between the plugs and the socket, and the deformation of the skirt conceals a portion of the wires inside the receiving space and the wires extend out from the hole.

7. The enclosure as claimed in claim 6, wherein the neck has an outer flange formed on an outer face thereof to correspond to the bottom plate and an inner flange formed on an inner face thereof to correspond to the pair of resilient hooks.

8. The enclosure as claimed in claim 7, wherein a thickness between the top face and a bottom face of the clamp is at least the same as that of a combination of a thickness of the outer flange and a thickness of the skirt.

9. The enclosure as claimed in claim 7, wherein a height of each of the resilient hooks is at least the same as a thickness of the inner flange, thereby after the peripheral edge of the skirt is placed under the outer flange, the engagement of the resilient hooks with the inner flange allows the clamp to securely clamp the skirt.

10. The enclosure as claimed in claim 8, wherein a height of each of the resilient hooks is at least the same as a thickness of the inner flange, thereby after the peripheral edge of the skirt is placed under the outer flange, the engagement of the resilient hooks with the inner flange allows the clamp to securely clamp the skirt.

* * * * *